United States Patent [19]

Prange et al.

[11] 4,070,251

[45] Jan. 24, 1978

[54] INCLINED CHAMBER COKE OVEN

[75] Inventors: Kurt Prange, Hattingen; Friedrich Isermann, Essen; Ernst Hasenäcker, Hattingen; Manfred Blase, Essen, all of Germany

[73] Assignee: Didier Engineering GmbH., Essen, Germany

[21] Appl. No.: 751,711

[22] Filed: Dec. 17, 1976

[30] Foreign Application Priority Data

Dec. 30, 1975 Germany ..... 2559131

[51] Int. Cl.[2] ..... C10B 1/08; C10B 5/04; C10B 11/00

[52] U.S. Cl. ..... 202/130; 202/142; 202/128; 202/220; 202/222

[58] Field of Search ..... 202/128, 130, 142, 220, 202/222, 223, 247, 248, 242

[56] References Cited

U.S. PATENT DOCUMENTS

| | | | |
|---|---|---|---|
| 279,099 | 6/1883 | Lürmann | 202/222 X |
| 971,137 | 9/1910 | Mueller | 202/223 X |
| 1,255,579 | 2/1918 | Bredel et al. | 202/128 |
| 3,953,299 | 4/1976 | Strepelis et al. | 202/220 X |

FOREIGN PATENT DOCUMENTS

| | | |
|---|---|---|
| 144,579 | 1/1903 | Germany. |
| 151,136 | 4/1901 | Germany. |

*Primary Examiner*—Morris O. Wolk
*Assistant Examiner*—Michael S. Marcus
*Attorney, Agent, or Firm*—Wenderoth, Lind & Ponack

[57] ABSTRACT

An inclined chamber has vertical heating flues on each side thereof. The floors of the heating flues are vertically staggered in an inclined manner. Pairs of heating flues are joined at the tops thereof by guide openings which are vertically staggered in an inclined manner. Central and upper air inlet openings extend into the heating flues and are vertically staggered in an inclined manner.

11 Claims, 3 Drawing Figures

INCLINED CHAMBER COKE OVEN

BACKGROUND OF THE INVENTION

The invention relates to an inclined chamber coke oven, in particular for the coking of briquette-shaped material, of the type having an oven chamber defined by a horizontal chamber ceiling, a chamber floor inclined downwardly from the heating side to the coke removal side of the oven, and lateral chamber walls in the form of heating walls.

German Pat. Nos. 144,579 and No. 151,136 respectively disclose a gasification oven, and an oven for the manufacture of peat coke and having a horizontal chamber ceiling and an inclined chamber floor. In the case of the oven of German Pat. No. 144,579, the chamber is filled only partly through an opening positioned near the heating side of the oven in a manner such that, for reasons of uniform heating and collection of the gases above the charge in the chamber, the charge has an approximately uniform height at all positions above the chamber floor. Consequently, the chamber volume cannot be fully utilized, since a completely filled chamber would lead to irregular coking. Also, in the oven of German Pat. No. 151,136, which is employed for the coking of peat, the peat is coked differently at different levels of the oven chamber. This, of course, is undesirable.

German Pat. Nos. 198,471, 235,038, 378,200, 411,885, 445,450 and 671,997 disclose chamber ovens comprising fully inclined chambers, i.e. both the chamber ceiling and the chamber floor are inclined. The ovens are equipped with vertical heating flues in the chamber walls for the purpose of heating the material in the oven chambers. Since the chambers are of uniform height in these ovens, it is also possible to achieve a certain degree of uniformity of coking. However, such chamber ovens are quite complex in structure and the chamber volumes thereof are correspondingly lower in comparison with an oven chamber having a horizontal chamber ceiling and an inclined chamber floor. Furthermore, the oven chamber of such an oven can in practice be charged only through a single filling hole.

SUMMARY OF THE INVENTION

Accordingly, the object of the present invention is to provide an inclined chamber coke oven of the type mentioned above, but which guarantees uniform coking, even in connection with the utilization of the entire chamber space, i.e. in spite of full utilization of the available chamber space which is nonuniform in height, and which is simple to operate with regard to charging, heating and emptying of the oven chamber.

The above object is achieved according to the present invention in that the heating walls of the chamber have therein vertical heating flues joined to each other in pairs by means of guide openings. The heating flue floors are provided with feed nozzles which are vertically staggered in a manner such that a line connecting the feed nozzles of the heating flues is inclined in a manner parallel to the inclination of the chamber floor. The guide openings of the heating flues are vertically staggered in a manner such that a line connecting the guide openings is inclined downwardly from the heating side to the coke removal side of the oven at an inclination less than that of the chamber floor. Air is supplied to the heating flues at different vertical levels therein through upper and central air entry openings which are each vertically staggered in a manner such that a line connecting the central openings and a line connecting the upper openings each are inclined downwardly from the heating side to the coke removal side of the oven at inclinations less than that of the chamber floor but greater than that of the line connecting the guide openings.

By this arrangement, it is possible to achieve uniform coking, in spite of the different heights of the chamber. The chamber provided with the inclined floor can first be fully charged to the top of the chamber. At the beginning of the coking operation, the charge shrinks in the areas of greater chamber height to a greater extent and a faster rate than in the areas of lesser chamber height. In the area of the coke removal side of the chamber, there is automatically formed a gas collection space above the charge, and the upper surface of the charge extends in a more and more downwardly inclined manner from the heating side to the coke removal side. Uniform coking is achieved through the staggered arrangement of the guide openings between the heating flues arranged in pairs and the staggered arrangement of the air outlet openings of the heating flues. The intake capacity of the oven of the invention is substantially greater than that of the known oven having a uniform chamber height.

Uniform coking can be still further improved by providing lower air inlet openings on the floors of the heating flues. The lower air inlet openings, on the one hand, and the central and upper air inlet openings, on the other hand, are preferably separately supplied with air.

Each of the heating flues are advantageously associated with regenerators the volumes of which are varied in a staggered manner in accordance with the heat requirements of the corresponding heating flues. Thus, the individual regenerator volumes are adapted to the differential amounts of exhaust gas obtained in the respective heating flues having different heights.

In accordance with a further feature of the invention, each of the heating flues is connected to a separate gas duct, all of the gas ducts separately extending to the heating side of the oven. Thus, each heating flue can be separately regulated. That is, gas can be supplied through individual ducts exclusively from the heating side, or the gas ducts may be led vertically into the base of the oven or facility.

An advantageous utilization of the space beneath the oven chambers and the heating walls results when the regenerators are designed to each have a vertical section or length portion and a horizontal section or length portion. Each regenerator is connected to a corresponding floor duct which ends separately in the heating side of the oven. In this manner it is possible to achieve, with an economic use of space and by simple means, the regulation of the feed air and/or of the exhaust gas exclusively from the heating side of the oven.

The possibility of optimal adjustment of all combustion media for the separate flues results from the fact that both the gas ducts and the floor ducts can be separately connected and controlled from the exterior of the oven.

In a further feature of the invention, the inclined chamber coke oven is provided with a number of charging holes in the chamber ceiling, which holes are arranged and distributed along the length of every oven chamber. This arrangement shortens the charging operation, and it is thus possible to achieve a uniform, approximately even distribution of the charge in the chamber.

At least the charging hole which is positioned adjacent the heating side of the oven expediently extends in an inclined manner toward the heating side of the oven, so that the entering flow of coal cannot drop through the charging hole directly vertically, but rather is deflected. This produces a gentle handling of the coal briquettes. Further, due to the inclined arrangement of the charging hole or holes, the coal briquettes actually strike the chamber floor after dropping the smallest possible height, and at the highest possible point of the chamber floor. The charging hole positioned adjacent the heating side of the oven is filled first. The remaining charging holes are used simultaneously or one after another.

An opening for drawing off gas from within the chamber is provided in the chamber ceiling, preferably in the area of maximum chamber height. Since an approximately wedge-shaped gas collection space increasing toward the coke removal side of the oven is formed above the charge, the gas can thus be drawn off simply and completely.

BRIEF DESCRIPTION OF THE DRAWINGS

Further objects, features and advantages of the present invention will become apparent from the following detailed description of an exemplified preferred embodiment thereof, with reference to the attached drawings, wherein.

DETAILED DESCRIPTION OF THE INVENTION

Figure 1:
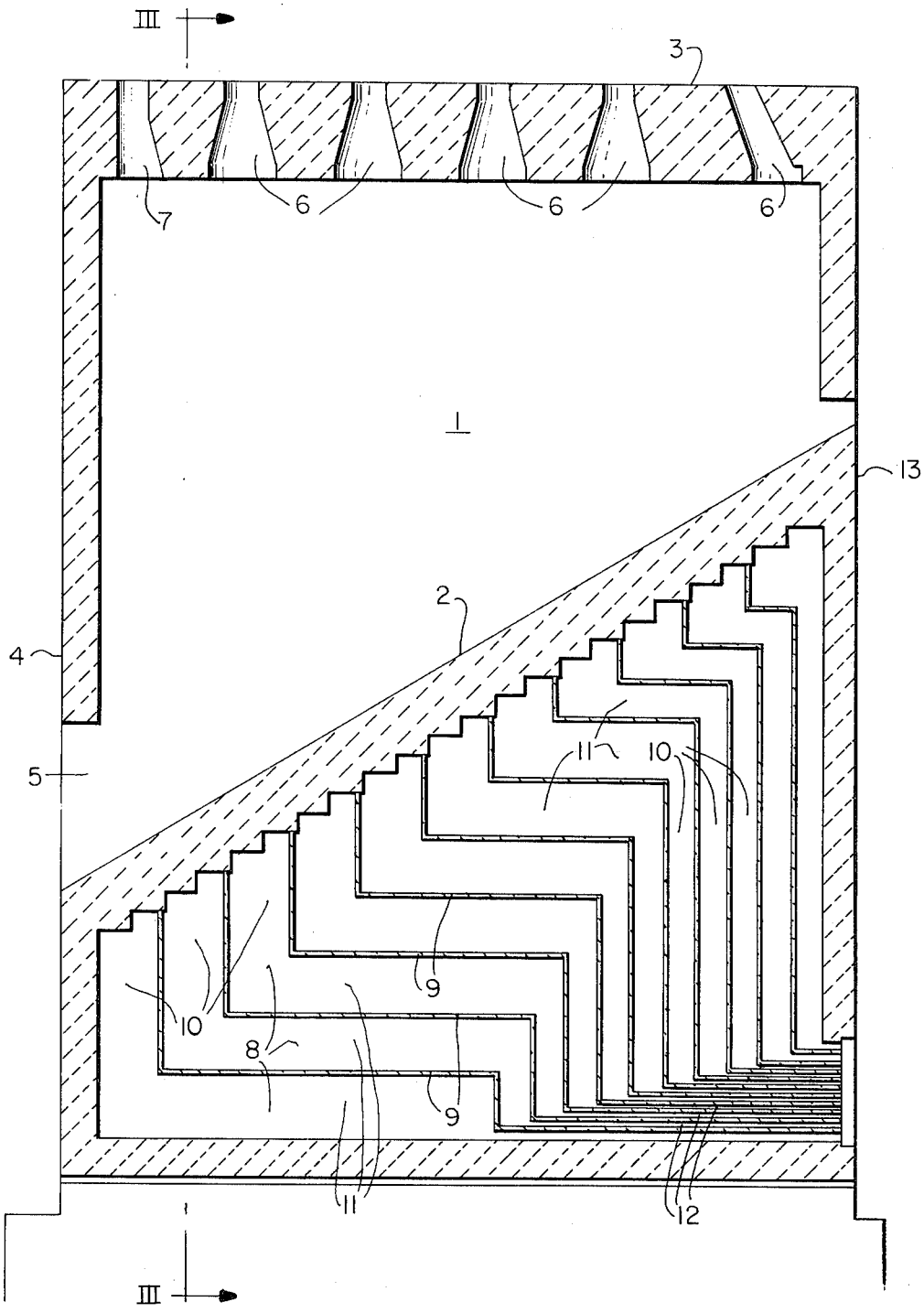
FIG. 1 is a section through an inclined chamber coke oven according to the invention, through an oven chamber thereof, along line I—I of FIG. 3.

As shown in FIG. 1, a coke oven has an oven chamber 1 defined by an inclined chamber floor 2 and a horizontal chamber ceiling 3. A coke outlet opening 5 is provided at the lowest end of chamber floor 2 in a coke removal side 4 of the oven. Opening 5 can be closed by a coke oven door, not shown. A desired number, e.g. five, of charging holes 6 are provided in chamber ceiling 3, holes 6 widening somewhat from the top to the bottom thereof. The charging hole 6 situated closest to a heating side 13 of the oven extends approximately perpendicularly to chamber floor 2, and therefore is inclined to heating side 13, in order to facilitate gentle charging of the fill material into the chamber. An opening 7 is provided at the area of greatest height of chamber 1 for drawing off gas therefrom.

Regenerators 8 are arranged under oven chamber 1, the regenerators 8 being separated from each other by partitions 9. Each regenerator 8 has a vertical section or length 10 and a horizontal section or length 11, in order to obtain an advantageous utilization of space. The volumes of the separate regenerators 8 are staggered, so as to be adapted to the amounts of exhaust gas obtained in respective heating flues 18 of different height. Flues 18 are associated with respective regenerators and are provided in heating walls 17 on opposite sides of chamber 1. Since a greater quantity of hot exhaust gas is obtained in longer heating flues 18 than in shorter ones, the volume of regenerators 8 associated with longer heating flues 18 is greater than that of the regenerators associated with the shorter heating flues. Each regenerator 8 is connected to a floor duct 12, which extends horizontally and which ends on heating side 13 of the oven.

Figure 3:
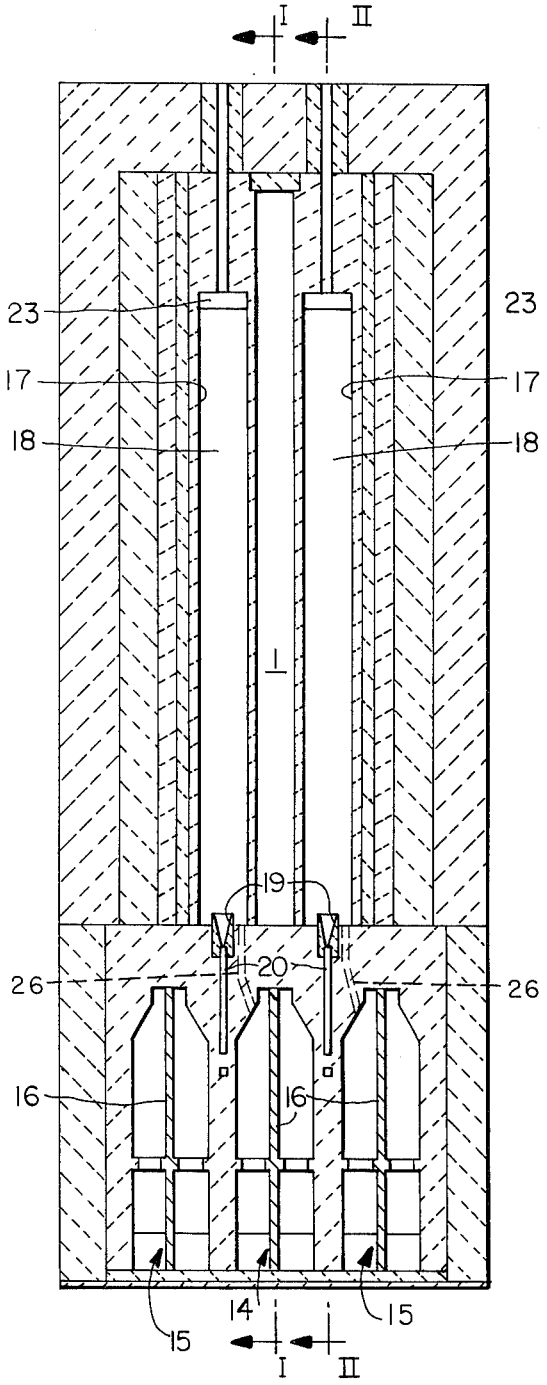
FIG. 3 is a cross-section through a portion of an inclined chamber coke oven having a single oven chamber, along line III—III of FIG. 1.

From the sectional view of FIG. 3, it will be seen that beneath single oven chamber 1 a main regenerator group 14 comprising regenerators 8 is provided for between separate lateral regenerator groups 15 adjacent to the side walls of the oven and also comprising regenerators 8. All of the regenerator groups 14 and 15 are each divided by a partition 16. The portion of inclined chamber coke oven shown in FIG. 3, and illustrated as having a single oven chamber 1, can be designed to have further oven chambers 1 each between two heating walls 17 and further main regenerator groups 14 one group being beneath each oven chamber 1 and all main regenerator groups 14 being arranged between the two lateral regenerator groups 15 adjacent to the side walls of the oven. So each chamber 1 may be coupled with a main regenerator group 14 and two further regenerator groups 14 or 15 adjacent to the said first main regenerator group 14 so that e.g. combustion air will be conducted through each second regenerator 8 of the groups 14 and 15 to corresponding heating flues 18 of a single chamber 1 and hot exhaust air will be conducted from corresponding heating flues 18 of the said single chamber 1 through each remaining second regenerator 8 of the groups 14 and 15 or vice versa when the direction of firing is reversed (see also below).

Figure 2:
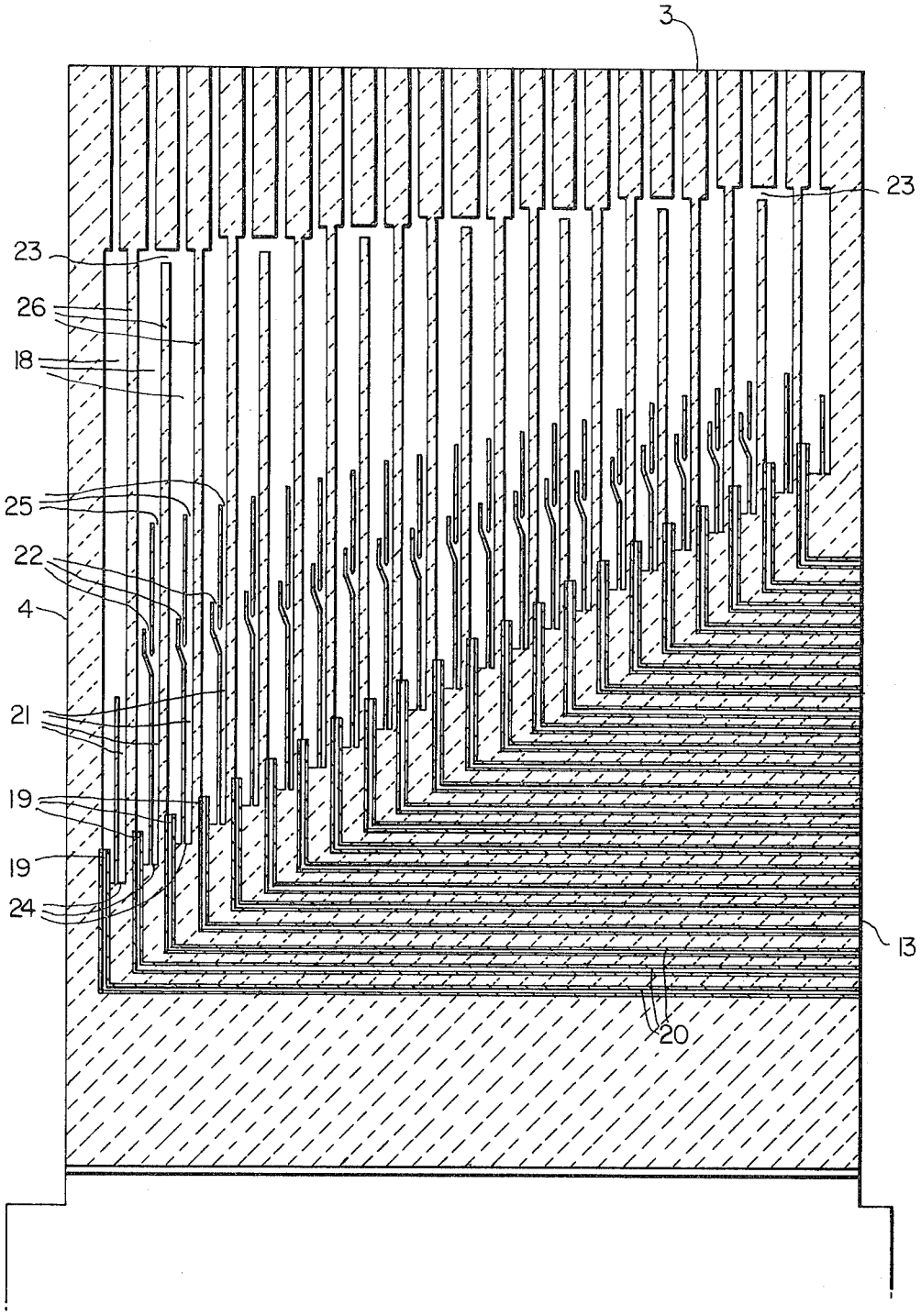
FIG. 2 is a section through the inclined chamber coke oven of FIG. 1, but through the heating flues thereof, along line II—II of FIG. 3.

FIG. 2 shows the arragement of vertical heating flues 18 provided in heating walls 17 which define oven chamber 1. Each regenerator 8 is associated with two heating flues 18, which two flues are associated with each other as a flue pair. Floors or bases 24 of heating flues 18 are aligned or situated on an inclined line which extends in a direction parallel with oven floor 2. In the area of floor 24 of each heating flue 18, there is arranged a brick 19, in the form of a nozzle and which contains the end of a gas duct 20. Gas ducts 20 are led separately and horizontally to heating side 13 of the oven, as shown in FIG. 2. Further, floors 24 of the heating flues are equipped with lower air outlet openings 26.

Into each heating flue 18, there extends an air duct 21. Each air duct 21 has a central air outlet opening 22 and an upper air outlet opening 25. Air ducts 21 are formed in correspondingly shaped bricks in header brick walls 26 between heating flues 18. Air outlet openings 22 and 25 of air ducts 21 are positioned along separate lines inclined downwardly from heating side 13 to coke removal side 4 of the oven. The line connecting openings 22 extends approximately below the vertical centers of heating flues 18, and the line connecting openings 25 extends approximately through the vertical centers of heating flues 18. The inclination of both of these lines is less than the inclination of chamber floor 2. This arrangement makes it possible to form in each heating flue 18 a very long flame corresponding to the height of oven chamber 1, at the particular area thereof corresponding to each flue, so that the charge in the oven chamber 1 can be heated and coked uniformly. Accordingly, the air inlet openings into each heating flue 18 are positioned at three different levels therein, i.e. a separate feed for the lower air inlet openings 26 in floors 24 of heating flues 18, and combined central and upper air inlet openings 22 and 25, respectively. It is to be understood that combustion air can pass from each regenerator to the air inlets of the corresponding heating flues and exhaust air can pass from each heating flue through the air inlets into the corresponding regenerators (see also below).

Pairs of heating flues 18 are joined to each other at upper ends thereof by means of guide openings 23, which are positioned on a connecting line which is inclined downwardly from heating side 13 to coke removal side 4 of the oven. The connecting line of openings 23 is less inclined than chamber floor 2 and is also less inclined than the connecting lines on which air outlet openings 22 and 25 are arranged. Guide openings 23 between taller heating flues 18 are located at positions deeper within the oven than guide openings 23 between shorter heating flues 18, in accordance with the degree of coal shrinkage in the adjacent areas of the oven chamber 1. This assists in providing uniform heating of the charge of the oven chamber. Accordingly, in spite of the non-uniform height of oven chamber 1, a uniform coking effect is achieved through the above discussed arrangement of the heating flues 18 and through the thus achieved particular arrangement of flame.

The above described oven can be operated by different types of heating. When operated as twin-flue oven, for example, each second gas duct 20 is connected to a gas pipe, and the remaining gas ducts 20 are supplied with only a small quantity of air for the purpose of burning possible deposits of carbon or graphite. Preheated combustion air is supplied, from regenerators 8 associated therewith, through air ducts 21, and possibly through the corresponding lower air inlets 26, of each second heating flue 18. The air ducts 21, and possibly the corresponding lower air outlets, of the intermediate heating flues 18 lead the exhaust gases into associated regenerators 8. After a certain period of time, the direction of firing is reversed. Thus, the lower air openings 26 in the floor 24 and openings 22 and 25 can alternately be operated as inlet or outlet openings.

Various modifications may be made to the above specifically described structural arrangements without departing from the scope of the invention.

What is claimed is:

1. An inclined chamber coke oven, particularly for the coking of coal in briquette form, said oven comprising:

an oven chamber defined by a horizontal chamber ceiling, a heating side, a coke removal side, a chamber floor inclined downwardly from said heating side to said coke removal side, and opposite lateral heating walls;

a plurality of vertical heating flues within each of said heating walls, each of said heating flues having a floor, the floors of said heating flues being vertically staggered such that a line joining said floors is inclined in a direction parallel to said chamber floor;

each of said floors having extending therein a gas feed nozzle;

upper ends of adjacent pairs of said heating flues being joined by guide openings, said guide openings being vertically staggered such that a line joining said guide openings is inclined by an inclination less than that of said chamber floor;

each of said heating flues having therein central and upper air inlet openings, said central and upper openings each being vertically staggered such that a line joining said central openings and a line joining said upper openings are each inclined by an inclination less than that of said chamber floor but greater than that of the line joining said guide openings.

2. An oven as claimed in claim 1, wherein each of said heating flue floors has therein a lower air inlet opening.

3. An oven as claimed in claim 2, wherein said lower air inlet openings are supplied by a first air feed, and said central and upper air inlet openings are supplied by a second air feed separate from said first air feed.

4. An oven as claimed in claim 1, further comprising a plurality of separate regenerators, each of said regenerators being associated with a respective heating flue, the volumes of said regenerators being different in proportion with varying heat requirements of said respective heating flues.

5. An oven as claimed in claim 4, wherein each of said regenerators includes a vertical length portion, a horizontal length portion and a floor duct, said floor ducts extending separately to said heating side of said oven.

6. An oven as claimed in claim 1, further comprising a separate gas duct connected to each of said heating flues through the respective said gas feed nozzle thereof.

7. An oven as claimed in claim 6, wherein said gas ducts extend separately to said heating side of said oven.

8. An oven as claimed in claim 6, wherein said gas ducts extend separately to a base of said oven.

9. An oven as claimed in claim 1, further comprising a plurality of charging holes extending through said chamber ceiling, said charging holes being distributed in the direction of the length of said chamber ceiling.

10. An oven as claimed in claim 9, wherein at least said charging hole positioned adjacent said heating side of said oven is inclined in a direction toward said heating side.

11. An oven as claimed in claim 1, further comprising an opening in said chamber ceiling for drawing off gas from said chamber, said opening being provided in said chamber ceiling at an area thereof adjacent an area of maximum chamber height.

* * * * *